United States Patent [19]

Matsuda

[11] Patent Number: 4,553,029

[45] Date of Patent: Nov. 12, 1985

[54] MASS SPECTROMETER

[75] Inventor: Hisashi Matsuda, Hyogo, Japan

[73] Assignee: Jeol Ltd., Tokyo, Japan

[21] Appl. No.: 611,427

[22] Filed: May 17, 1984

[30] Foreign Application Priority Data

May 24, 1983 [JP] Japan ..... 58-91315

[51] Int. Cl.[4] ..... H01J 49/32

[52] U.S. Cl. ..... 250/296; 250/396 R

[58] Field of Search ..... 250/294, 296, 297, 396 R

[56] References Cited

U.S. PATENT DOCUMENTS 4,418,280 11/1983 Matsuda ..... 250/296

4,480,187 10/1984 Matsuda ..... 250/296

*Primary Examiner*—Alfred E. Smith

*Assistant Examiner*—Jack I. Berman

*Attorney, Agent, or Firm*—Webb, Burden, Robinson & Webb

[57] ABSTRACT

A mass spectrometer has a uniform magnetic field and an electric field. Further, the spectrometer is equipped with three spaced electrostatic quadrupole lenses. The deflection angle $\phi_m$ of the beam in the magnetic field, the radius $r_m$ of the circle described by the beam in the magnetic field, the deflection angle $\phi_e$ of the beam in the electric field, and the radius $r_e$ of the circle described by the beam in the electric field are so set as to satisfy the following relations:

$$82° \leqq \phi_e \leqq 88°;$$

$$39° \leqq \phi_m \leqq 41°$$

$$0.715 \leqq r_e/r_m \leqq 0.755.$$

The spectrometer can measure masses over a wide range even if it is built as a small-sized instrument. Thus, the instrument is able to measure molecular ions of large masses.

4 Claims, 6 Drawing Figures

MASS SPECTROMETER

BACKGROUND OF THE INVENTION

The present invention relates to a mass spectrometer which can measure masses over a broad range and is excellent in sensitivity and resolution and which can be miniaturized.

In recent years, there is an increasing need for analysis of molecules of larger masses in biochemical and other applications, and an ionizing method for ionizing samples by bombardment with high-speed primary ions or neutral particles has attracted interest accordingly. This method can relatively easily produce ions of large molecules having mass-to-charge ratios of the order of 2000 to 5000 that have been unfeasible with conventional electron bombardment ionization or chemical ionization. At present, none but large-sized mass spectrometers can analyze molecular ions of such large masses. Unfortunately, large-sized mass spectrometers are quite expensive and so the fact is that only limited researchers are able to employ these instruments. Accordingly, small-sized or medium-sized mass spectrometers capable of making analysis up to the region of large masses are required, and various attempts have been made as described below.

A scheme has been developed in which an electric field E and a uniform sectorial magnetic field H are used just like a conventional small-sized or medium-sized mass spectrometer as shown in FIG. 1(*a*), but the deflection angle $\phi_m$ of ions in the magnetic field is made smaller to extend the measurable range of masses as shown in FIG. 1(*b*). In FIGS. 1(*a*) and 1(*b*), indicated by S and D are an ion source and an ion detector, respectively. The reduction in the angle $\phi_m$ lengthens the orbit of the ions thus to spread the ion beam longitudinally. This deteriorates the transmission efficiency of ions and reduces the sensitivity. Another major disadvantage is that the spread of ion beam increases higher-order aberrations, i.e., second-order and third-order aberrations, with a concurrent reduction in the resolution.

The present inventor has already proposed a mass spectrometer that is excellent in sensitivity and resolution, as described in detail in U.S. Pat. No. 4,480,187, corresponding to Japanese published, unexamined patent application No. 19848/1983. As schematically shown in FIG. 2, this proposed system consists of an ion source S, a uniform sectorial magnetic field H, and a torodial electric field E. This system is characterized by the provision of two electrostatic quadrupole lenses Q1 and Q2 between the ion source S and the electric field H to converge the passing beam of ions in a direction perpendicular to the plane of the orbit of the beam and to diverge the beam radially of the beam.

SUMMARY OF THE INVENTION

It is the main object of the present invention to provide a mass spectrometer which is an improvement over the instrument proposed by the present inventor as described above and which can enjoy the advantage of a broader measurable range of masses, thus permitting analysis of molecular ions of larger masses while maintaining the good sensitivity and resolution.

It is another object of the invention to provide a relatively smallsized mass spectrometer which is capable of analyzing molecular ions of larger masses.

These and additional objects of the invention are achieved in accordance with the teachings of the invention by a mass spectrometer which has an ion source, an ion detector for detecting the ions emitted from the source, a uniform magnetic field set up between the ion source and the ion detector, an electric field set up between the magnetic field and the ion detector, two spaced electrostatic quadrupole lenses disposed between the ion source and the magnetic field for converging the beam of ions in a direction perpendicular to the plane of the orbit of the beam and for diverging the beam radially of the beam, and another electrostatic quadrupole lens disposed between the magnetic field and the electric field for converging the beam in the direction perpendicular to the plane of the orbit, the deflection angle $\phi_m$ of the beam in the magnetic field, the radius $r_m$ of the circle described by the beam in the magnetic field, the deflection angle $\phi_e$ of the beam in the electric field, and the radius $r_e$ of the circle described by the beam in the electric field being so determined as to satisfy the following relations:

$$82° \leqq \phi_e \leqq 88°$$

$$39° \leqq \phi_m \leqq 41°$$

$$0.715 \leqq r_e/r_m \leqq 0.755$$

Other objects, advantages, and features of the invention will be apparent from the following description of the preferred embodiment taken in conjunction with the accompanying drawings.

PREFERRED EMBODIMENT OF THE INVENTION

Figure 3:
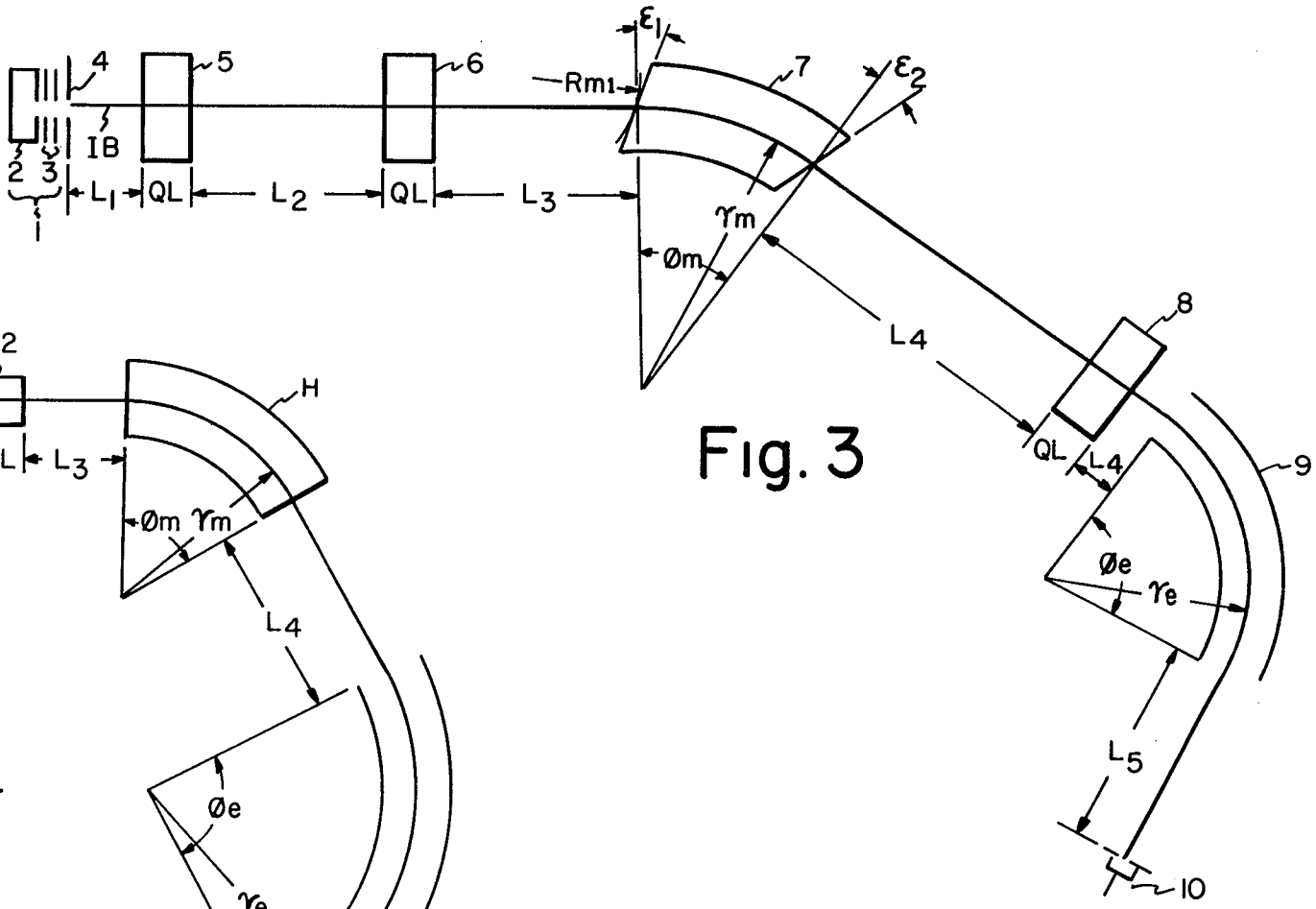
FIG. 3 is a schematic diagram of a mass spectrometer according to the present invention.

Referring to FIG. 3, there is shown the geometry of a mass spectrometer embodying the concept of the invention. The spectrometer includes an ion source 1, which has an ionization chamber 2 and a plurality of electrodes 3. An ion beam IB accelerated in the ion source goes out of it through a slit in baffle 4. Then, the beam IB is caused to enter a uniform sectorial magnetic field 7 after passing through two electrostatic quadrupole lenses 5 and 6. In the magnetic field 7, the ions are separated according to their mass-to-charge ratios. Those ions which have a specific mass-to-charge ratio then pass through an electrostatic quadrupole lens 8 and a cylindrical electric field 9, and they are caused to enter an ion detector 10 for detection. The magnetic field 7 is so designed that its field strength is repeatedly and quickly swept by a power supply (not shown). Accordingly, as the field strength is varied, the mass-to-charge ratio of the ions passing through the magnetic field 7 changes, so that the mass of the ions picked up by the detector 10 alters. Thus, the signal obtained from the detector 10 provides a mass spectrum. The entrance end surface and the exit end surface of the magnetic field 7 are tilted at angles of $\epsilon_1$ and $\epsilon_2$, respectively, to cause the beam of ions to enter and leave it obliquely. The entrance end surface is curved with a radius of curvature of $R_{m1}$.

Figure 4:
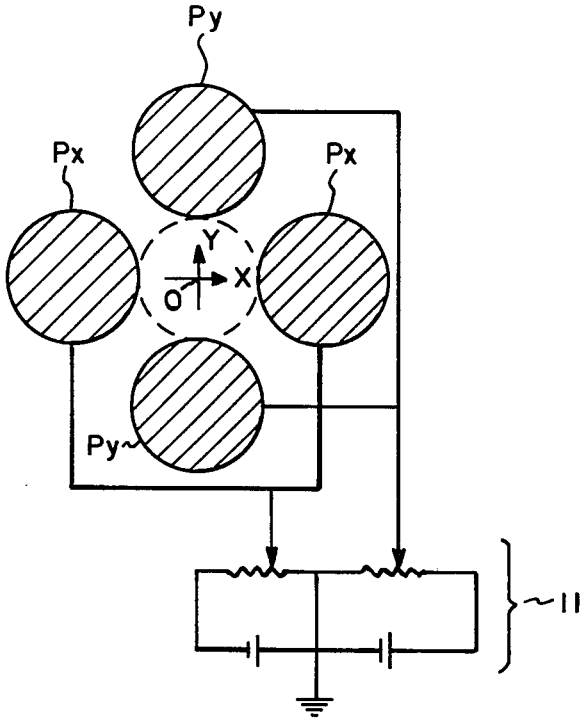
FIG. 4 is a view showing the cross-sectional shape of the electrostatic quadrupole lenses shown in FIG. 3 and the configuration of a power supply for applying a voltage to the lenses.

Referring next to FIG. 4, the structure of each of the electrostatic quadrupole lenses 5, 6, 8 is shown in cross section, together with the configuration of a power supply 11 for bringing these lenses to certain electric potentials. Specifically, each lens consists of four cylindrical electrodes which are spaced 90° from each other in symmetrical relation with respect to the path O of the beam of ions. When positive ions are analyzed, a positive voltage is applied to the electrodes $P_y$ opposed to each other in a direction (y-direction) perpendicular to the plane of the path of the beam, while a negative voltage is applied to the electrodes $P_x$ opposed to each other radially of the beam (x-direction). Thus, positive ions experience a force that converge them in the y-direction and a force that diverges them in the x-direction. It is to be noted that the quadrupole lens 8 is disposed at the focal point in the x-direction and hence it has little effect on the beam in the x-direction. For this reason, the lens 8 is given only a focusing function in the y-direction.

Figure 5:
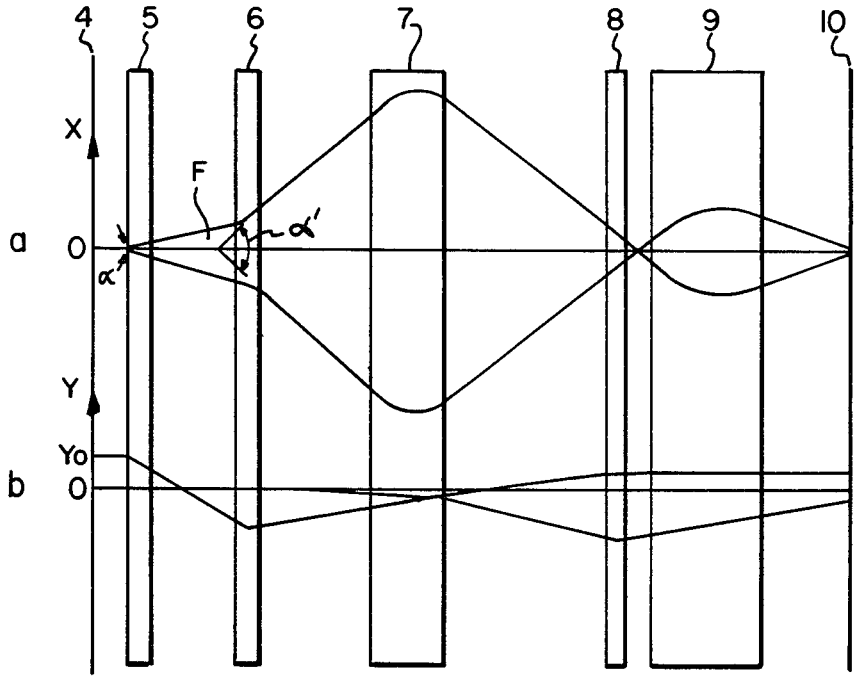
FIG. 5 is a diagram showing the flow of ion beam in an ion-optical system according to the invention.

The manner in which the ion beam IB flows in the aforementioned ion-optical system is shown in FIG. 5, where (a) shows changes in the width of the beam in the x-direction. The ion beam emitted with a dispersion angle $\alpha$ in the x-direction from the ion source 1 at the left end is diverged by the action of the lenses 5 and 6 such that the dispersion angle is increased to $\alpha'$. Consequently, the beam enters the magnetic field 7 as if it were emitted from a point F. At this point, image magnification X is equal to $\alpha/\alpha'$, which means a reduction of the image. The resolution of a magnetic field type mass spectrometer is given by $$R=\gamma\cdot r_m/(X\cdot S+\Delta+d)$$

where S is an ion source, d is the slit width of an ion detector, $\gamma$ is the mass dispersion coefficient, and $\Delta$ is the spread of image due to aberrations. Therefore, such a reduction in the image yields a higher resolution.

After entering the magnetic field 7, the width of the beam is gradually reduced by the converging action of the field 7 and once focused at a point close to the exit end of the quadrupole lens 8. Then, the beam enters the electric field 9 which is arranged to cooperate with magnetic field 7 for satisfying a double focusing condition. After undergoing the converging action of the electric field 9, the beam is again converged at the detector 10.

FIG. 5(*b*) shows the orbit of the beam of ions in the y-direction. As can be seen from this figure, the height of the beam is held down to a quite small value within the magnetic field 7 by the converging action of the lenses 5 and 6 in the y-direction. This makes it possible to reduce the gap between the magnetic poles, thus increasing the magnetic field strength. For the same space between the magnetic poles, a larger quantity of ions can be effectively passed between them, leading to an increase in the sensitivity.

The present invention is characterized in that the ion-optical system of FIG. 3 which exhibits excellent characteristics, i.e., high resolution and high sensitivity, is so set as to fulfill the following conditions.

$$82° \leqq \phi_e \leqq 88°;$$

$$39° \leqq \phi_m \leqq 41°$$

$$0.715 \leqq r_e/r_m \leqq 0.755$$

In the above formulas and in the following tables the following definitions of symbols applies: $\phi_m$=angle (in degrees) of deflection of ion beam caused by magnetic field; $\phi_e$=angle of deflection of ion beam caused by electric field; $r_m$=radius of circle described by ion beam in magnetic field; $r_e$ =radius of circle described by ion beam in electric field; $R_{m1}$=radius of curvature of entrance end surface of magnetic field; QL=length of electrostatic quadrupole lenses; QK1, QK2, QK3=capabilities of electrostatic quadrupole lenses 5, 6, 8, respectively; L1-L5=distances given in FIGS. 1(*b*), 2, and 3; Ax=image magnification; A$\gamma$=mass dispersion coefficient; Ay, A$\beta$=coefficients indicative of spread of beam in the direction of height of beam at position of detector.

TABLE 1

| | (a) | (b) | (c) |
|---|---|---|---|
| $\phi_m$ | 35° | 72.5° | 40° |
| $\phi_e$ | 70° | 90° | 85° |
| $r_e/r_m$ | 0.643 | 0.9 | 0.735 |
| QL | — | 0.4 | 0.18 |
| QK1 | — | −2.08 | −3.89 |
| QK2 | — | −2.21 | −3.89 |
| QK3 | — | — | −2.25 |
| L1 | 0.814 | 0.25 | 0.4 |
| L2 | 1.779 | 1.0 | 0.75 |
| L3 | 1.576 | 0.6 | 0.90 |
| L4 | — | 2.059 | 1.1220 |
| L4' | — | — | 0.15 |
| L5 | — | 0.734 | 0.7617 |
| Ax | 0.521 | 0.186 | 0.211 |
| AY | 0.498 | −1.412 | −1.036 |
| Ay | 2.415 | 0.54 | 0.62 |
| A$\beta$ | 10.678 | −1.08 | −0.74 |
| AY/Ax | 0.957 | 7.59 | 4.91 |

Figure 1A:
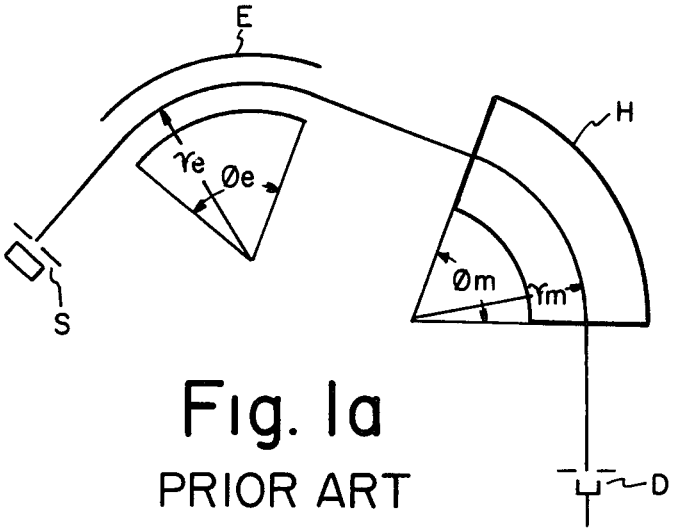
Fig. 1a PRIOR ART
FIGS. 1(*a*) and 1(*b*) are schematic diagrams of a conventional mass spectrometer.
Figure 1B:
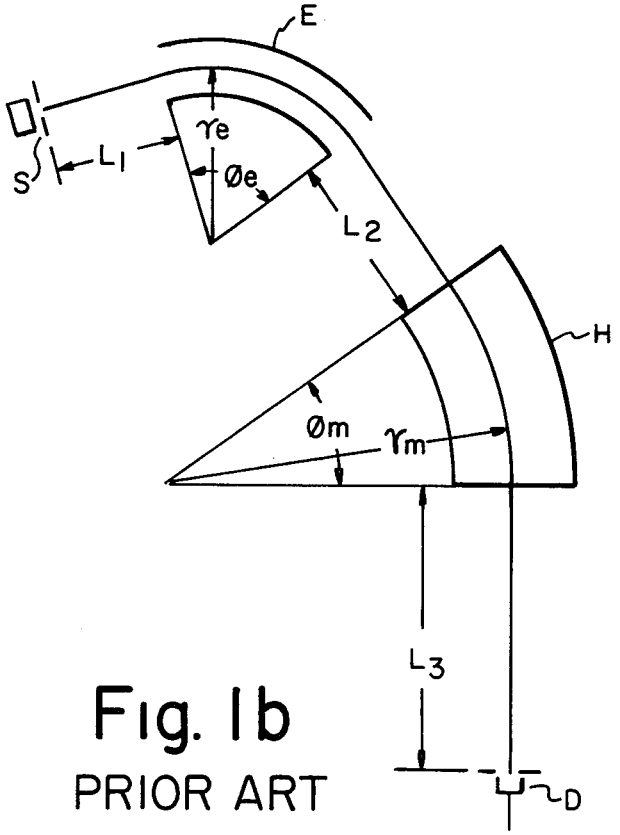
Fig. 1b PRIOR ART
Figure 2:
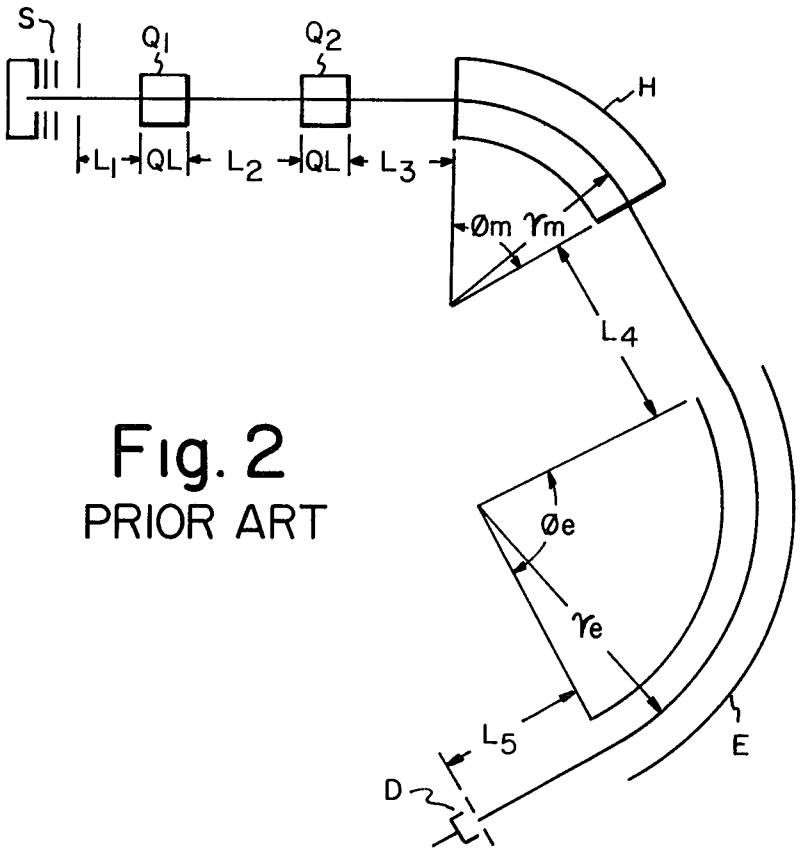
Fig. 2 PRIOR ART
FIG. 2 is a schematic diagram of the mass spectrometer already proposed by the present inventor.

In Table 1, columns (a), (b), and (c) give dimensions and parameters of the conventional instrument shown in FIG. 1(*b*), the instrument already proposed and shown in FIG. 2, and the instrument disclosed and claimed herein, respectively. These three instruments are hereinafter referred to as instruments (a), (b),and (c), respectively. All the lengths presented in Table 1 are normalized so that the radius $r_m$ of the circle described by the beam of ions in the magnetic field may assume a value of unity. In comparing the three instruments with respect to the two parameters $\phi_m$ and $r_e/r_m$ that affect the measurable range of masses and the size of the instrument, the instrument (a) has values of 35° and 0.643, the instrument (b) has values of 72.5° and 0.9, and the instrument (c) has values of 40° and 0.735. This means that the instruments (a) and (c) can extend the measurable range of masses without the need to make the structure large. In this respect, instrument (b) is disadvantageous.

Next, the three instruments are compared with respect to Ay, A$\beta$ and A$\gamma$/Ax(=mass dispersion/ion beam width). The parameters Ay and A$\beta$ indicate the transmission efficiency, and as these parameters become smaller, the efficiency is enhanced. The instrument (a) has values of 2.415, 10.678, and 0.957. The instrument (b) has values of 0.54, −1.08, and 7.59. The novel instrument (c) has values of 0.62, −0.74, and 4.91. Thus, the instruments (b) and (c) have smaller Ay, A$\beta$ and larger $A\gamma/Ax$ than the instrument (a). Consequently, for the same resolution or ion beam width, the instruments (b) and (c) are much superior in transmission efficiency to the instrument (a), and provide higher sensitivity.

Table 2 shows a list of second-order and third-order aberration coefficients obtained by making calculations for the instruments (a), (b), and (c) whose dimensions and parameters are listed in Table 1.

TABLE 2

| | (a) | (b) | (c) |
|---|---|---|---|
| $\phi_m$ | 35° | 72.5° | 40° |
| $\phi_e$ | 70° | 90° | 85° |
| AA | 5.094 | 0.02 | −0.04 |
| AD | 6.679 | 0.07 | 0.02 |
| DD | −1.975 | 0.04 | −0.26 |
| YY | −1.379 | 0.23 | 0.35 |
| YB | −10.394 | 0.68 | −0.60 |
| BB | −19.463 | 0.54 | 0.13 |
| XXX | 58.2 | 2054.2 | 11.6 |
| XXA | 144.9 | 5153.0 | 44.0 |
| XAA | 124.2 | 4301.0 | 48.6 |
| AAA | 37.8 | 1197.3 | 16.5 |
| AAD | 41.1 | −289.3 | 28.9 |
| ADD | 20.9 | 151.8 | 41.8 |
| AYY | −0.9 | 5.8 | −22.5 |
| AYB | −8.2 | −242.6 | −0.1 |
| ABB | −10.5 | 681.9 | 101.4 |
| DDD | −3.2 | −27.1 | −3.3 |
| DYY | 1.2 | −0.3 | −3.0 |
| DYB | 5.7 | 40.7 | 1.1 |
| DBB | −0.1 | −81.0 | −1.9 |

It is assumed that the practically required resolution is 50,000 and that the width of ion beam in the ion source is roughly equal to $r_m/(200–300)$. Then, it is desired that second-order aberration coefficients be less than at least 0.8–1 and that third-order aberration coefficients be less than at least 500–800. With respect to XXX, XXA, and XAA, the AA−BB=second-order aberration coefficients; XXX−DBB=third-order aberration coefficients, aberrations can be reduced by adjustment of the slit in the ion source or other means and so the third-order aberration coefficients can be allowed up to about 1,000. The second-order and third-order aberration coefficients which determine the resolution are now compared, taking into account these values. The conventional instrument (a) has relatively good third-order aberration coefficients, but the more important third-order aberration coefficients are all far out of the allowed range. The result is that the resolution is much worse than 50,000.

The instrument (b) has second-order aberration coefficients which are well within the allowed range, but it exhibits large third-order aberration coefficients. Therefore, it is difficult to attain a resolution that is considerably better than 50,000.

The novel instrument (c) which is an improvement over the instrument (b) has second-order and third-order aberration coefficients both of which are within their allowed ranges. Hence it is easy for this instrument to achieve a resolution of 50,000.

In summary, the instrument (c) of the invention can extend the measurable range of masses without deteriorating the aberrations, in contrast with the instrument (a), by making $\phi_m$ and $r_e/r_m$ small. The instrument (c) is similar in second-order aberrations but much excellent in third-order aberrations to the instrument (b). Further, the instrument (c) is as good as the instrument (b) in respect to transmission efficiency. In this way, an ideal mass spectrometer is accomplished which can measure masses over an extended range without the necessity of rendering the structure large and which yet yields high sensitivity and high resolution.

Tables 3, 4, and 5 show changes in the second-order and third-order aberration coefficients of the novel ion-optical system having excellent characteristics as noted above when $\phi_e$, $\phi_m$, and $r_e/r_m$ are changed in the vicinities of the values of the instrument (c) given in Tables 1 and 2 above, i.e., 85°, 40°, and 0.735, respectively.

TABLE 3

| $\phi_m$ | 38.0° | 38.5° | 39.0° | 39.5° | 40.0° | 40.5° | 41.0° | 41.5° | 42.0° |
|---|---|---|---|---|---|---|---|---|---|
| $\phi_e$ | 85° | 85° | 85° | 85° | 85° | 85° | 85° | 85° | 85° |
| $r_m/R_{m1}$ | −0.3479 | −0.3549 | −0.3621 | −0.3692 | −0.3764 | −0.3839 | −0.3915 | −0.3991 | −0.4064 |
| L3 | 1.1951 | 1.1762 | 1.1577 | 1.1396 | 1.1220 | 1.1047 | 1.0877 | 1.0711 | 1.0549 |
| L5 | 0.7737 | 0.7707 | 0.7678 | 0.7648 | 0.7617 | 0.7589 | 0.7560 | 0.7531 | 0.7502 |
| X | 0.223 | 0.220 | 0.217 | 0.214 | 0.211 | 0.208 | 0.205 | 0.202 | 0.200 |
| C | −1.368 | −1.042 | −1.040 | −1.038 | −1.036 | −1.034 | −1.032 | −1.030 | −1.029 |
| AA | 0.001 | −0.011 | 0.079 | 0.018 | −0.04 | 0.019 | 0.072 | 0.056 | −0.030 |
| AD | −1.914 | −1.424 | −0.937 | −0.457 | 0.02 | 0.491 | 0.959 | 1.423 | 1.881 |
| DD | −0.216 | −0.227 | −0.237 | −0.248 | −0.26 | −0.269 | −0.279 | −0.290 | −0.300 |
| YY | 0.390 | 0.380 | 0.370 | 0.361 | 0.35 | 0.342 | 0.333 | 0.324 | 0.316 |
| YB | −0.519 | −0.541 | −0.563 | −0.584 | −0.60 | −0.625 | −0.645 | −0.665 | −0.684 |
| BB | −0.111 | −0.046 | 0.015 | 0.074 | 0.13 | 0.184 | 0.235 | 0.285 | 0.333 |
| XXX | 880.0 | 664.6 | 439.3 | 228.0 | 11.6 | −208.4 | −433.1 | −651.6 | −863.6 |
| XXA | 1967.1 | 1490.3 | 991.4 | 523.4 | 44.0 | −443.1 | −940.9 | −1424.7 | −1894.5 |
| XAA | 1468.4 | 1116.4 | 748.1 | 402.5 | 48.6 | −311.1 | −678.6 | −1035.8 | −1382.7 |
| AAA | 365.9 | 279.3 | 188.7 | 103.6 | 16.5 | −72.0 | −162.5 | −250.4 | −335.8 |
| AAD | 52.4 | 46.3 | 40.3 | 34.4 | 28.9 | 22.9 | 17.4 | 11.9 | 6.5 |
| ADD | 41.8 | 41.8 | 41.8 | 41.8 | 41.8 | 41.9 | 41.9 | 42.0 | 41.9 |
| AYY | −23.3 | −23.1 | −22.9 | −22.7 | −22.5 | −22.3 | −22.1 | −22.0 | −21.8 |
| AYB | −0.4 | −0.4 | −0.3 | −0.2 | −0.1 | 0.1 | 0.3 | 0.5 | 0.7 |
| ABB | 101.7 | 101.6 | 101.5 | 101.4 | 101.4 | 101.4 | 101.5 | 101.6 | 101.7 |
| DDD | −3.3 | −3.3 | −3.3 | −3.3 | −3.3 | −3.3 | −3.3 | −3.3 | −3.3 |
| DYY | −2.5 | −2.6 | −2.7 | −2.8 | −3.0 | −3.1 | −3.2 | −3.3 | −3.4 |
| DYB | −1.7 | −1.0 | −0.3 | 0.4 | 1.1 | 1.7 | 2.3 | 2.9 | 3.4 |
| DBB | −2.0 | −2.0 | −2.0 | −1.9 | −1.9 | −1.9 | −1.8 | −1.8 | −1.8 |

It will be understood from the second-order coefficients given in Table 3 that $\phi_e$ is required to be set within the range from 82° to 88° in order that the value of AD lies within the aforementioned allowed range. If that range is established, the third-order aberration coefficients also lie substantially within the allowed range.

TABLE 4

| | | | | | | | |
|---|---|---|---|---|---|---|---|
| $\phi_m$ | 40° | 40° | 40° | 40° | 40° | 40° | 40° |
| $\phi_e$ | 90° | 88° | 86° | 85° | 84° | 82° | 80° |
| $r_m/R_{m1}$ | −0.3655 | −0.3694 | −0.3741 | −0.3764 | −0.3790 | −0.3843 | −0.3902 |
| L3 | 1.0984 | 1.1077 | 1.1171 | 1.1220 | 1.1269 | 1.1368 | 1.1471 |
| L5 | 0.6711 | 0.7056 | 0.7425 | 0.7617 | 0.7820 | 0.8246 | 0.8706 |
| X | 0.200 | 0.204 | 0.208 | 0.211 | 0.213 | 0.218 | 0.223 |
| C | −0.984 | −1.004 | −1.025 | −1.036 | −1.047 | −1.071 | −1.097 |
| AA | 0.044 | −0.077 | 0.022 | −0.04 | 0.011 | 0.027 | 0.040 |
| AD | −1.515 | −0.942 | −0.315 | 0.02 | 0.369 | 1.117 | 1.938 |
| DD | −0.150 | −0.192 | −0.235 | −0.26 | −0.281 | −0.330 | −0.382 |
| YY | 0.338 | 0.344 | 0.349 | 0.35 | 0.354 | 0.359 | 0.365 |
| YB | −0.559 | −0.576 | −0.595 | −0.60 | −0.616 | −0.639 | −0.664 |
| BB | 0.280 | 0.225 | 0.163 | 0.13 | 0.096 | −0.021 | −0.062 |
| XXX | 441.4 | 286.6 | 101.4 | 11.6 | −83.2 | −276.5 | −484.3 |
| XXA | 1014.1 | 665.5 | 247.6 | 44.0 | −171.1 | −618.8 | −1088.5 |
| XAA | 777.9 | 516.3 | 202.3 | 48.6 | −114.1 | −453.8 | −812.3 |
| AAA | 199.1 | 133.7 | 55.1 | 16.5 | −24.5 | −110.3 | −201.3 |
| AAD | 102.9 | 78.7 | 47.4 | 28.9 | 7.6 | −42.5 | −105.0 |
| ADD | 20.4 | 27.7 | 36.7 | 41.8 | 47.6 | 60.7 | 76.4 |
| AYY | −20.3 | −21.1 | −22.0 | −22.5 | −23.0 | −23.9 | −25.1 |
| AYB | −1.99 | −1.3 | −0.5 | −0.1 | 0.4 | 1.5 | 2.7 |
| ABB | 89.8 | 94.1 | 98.9 | 101.4 | 104.0 | 109.6 | 115.8 |
| DDD | −1.4 | −2.1 | −2.9 | −3.3 | −3.8 | −4.7 | −5.97 |
| DYY | −2.8 | −2.9 | −2.9 | −3.0 | −3.0 | −3.1 | −3.14 |
| DYB | 3.0 | 2.3 | 1.5 | 1.1 | 0.6 | −0.3 | −1.4 |
| DBB | −2.1 | −2.1 | −2.0 | −1.9 | −1.9 | −1.8 | −1.7 |

It can be seen from the second-order aberration coefficients given in Table 4 that $\phi_m$ should lie in the range from 39° to 41° in order that the values of AD and BB lie within the above-described ranges. If this range is attained, the third-order aberration coefficients also lie within the allowed range.

TABLE 5

| | | | | | | | | | |
|---|---|---|---|---|---|---|---|---|---|
| $r_e$ | 0.695 | 0.705 | 0.715 | 0.725 | 0.735 | 0.745 | 0.755 | 0.765 | 0.775 |
| Qk | −2.1068 | −2.1397 | −2.1862 | −2.2150 | −2.2501 | −2.2784 | −2.3113 | −2.3420 | −2.3699 |
| $r_m/R_{m1}$ | −0.3900 | −0.3865 | −0.3828 | −0.3797 | −0.3764 | −0.3734 | −0.3704 | −0.3674 | −0.3647 |
| L3 | 1.1319 | 1.1288 | 1.1271 | 1.1242 | 1.1220 | 1.1194 | 1.1174 | 1.1154 | 1.1133 |
| L5 | 0.6607 | 0.6866 | 0.7097 | 0.7364 | 0.7619 | 0.7889 | 0.8147 | 0.8412 | 0.8683 |
| X | 0.192 | 0.197 | 0.201 | 0.206 | 0.211 | 0.216 | 0.221 | 0.225 | 0.230 |
| C | −0.943 | −0.966 | 0.988 | −1.013 | −1.036 | −1.060 | −1.084 | −1.108 | −1.133 |
| AA | 0.011 | 0.014 | −0.015 | 0.000 | −0.002 | 0.001 | 0.003 | −0.013 | −0.000 |
| AD | 0.028 | −0.033 | 0.070 | 0.002 | 0.020 | −0.021 | 0.006 | 0.021 | 0.019 |
| DD | −0.203 | −0.210 | −0.234 | −0.242 | −0.258 | −0.269 | −0.288 | −0.306 | −0.322 |
| YY | 0.303 | 0.315 | 0.327 | 0.339 | 0.351 | 0.363 | 0.376 | 0.388 | 0.400 |
| YB | −0.514 | −0.538 | −0.565 | −0.585 | −0.605 | −0.623 | −0.639 | −0.654 | −0.666 |
| BB | 0.934 | 0.797 | 0.541 | 0.374 | 0.130 | −0.086 | −0.375 | −0.673 | −0.974 |
| XXX | −1135.1 | −825.9 | −578.6 | −267.2 | 11.8 | 314.7 | 590.3 | 872.5 | 1159.2 |
| XXA | −2488.5 | −1805.1 | −1259.1 | −571.4 | 44.6 | 713.2 | 1321.1 | 1943.5 | 2575.8 |
| XAA | −1815.9 | −1312.4 | −910.5 | −404.2 | 49.0 | 541.0 | 988.1 | 1445.6 | 1910.5 |
| AAA | −441.1 | −317.4 | −218.8 | −94.6 | 16.6 | 137.3 | 246.9 | 359.0 | 473.0 |
| AAD | 137.2 | 108.2 | 87.2 | 56.0 | 28.7 | −2.8 | −31.1 | −60.7 | −92.0 |
| ADD | 21.8 | 26.6 | 30.9 | 36.4 | 41.9 | 48.0 | 54.1 | 60.6 | 67.5 |
| AYY | −20.8 | −21.2 | −21.6 | −22.0 | −22.5 | −22.9 | −23.4 | −23.9 | −24.4 |
| AYB | −4.3 | −3.7 | −2.3 | −1.5 | −0.1 | 1.2 | 2.9 | 4.7 | 6.6 |
| ABB | 87.7 | 90.8 | 94.8 | 97.8 | 101.4 | 104.5 | 108.1 | 111.6 | 114.9 |
| DDD | −2.4 | −2.6 | −2.8 | −3.0 | −3.3 | −3.6 | −3.9 | −4.3 | −4.7 |
| DYY | −2.5 | −2.6 | −2.8 | −2.9 | −3.3 | −3.0 | −3.1 | −3.2 | −3.2 |
| DYB | 10.6 | 9.0 | 5.9 | 4.0 | 1.1 | −1.5 | −4.9 | −8.4 | −11.9 |
| DBB | −1.5 | −1.6 | −1.6 | −1.8 | −1.9 | −2.1 | −2.2 | −2.4 | −2.6 |

It can be seen from Table 5 that $r_e/r_m$ must lie approximately between 0.705 and 0.765 in order that the value of BB lie within the aforementioned allowed range. However, if $r_e/r_m$ is equal to 0.755, the third-order aberration coefficient is outside the allowed range. Accordingly, taking into account the second-order and third-order aberration coefficients, the value of $r_e/r_m$ should lie within the range from 0.715 to 0.755.

As thus far described, the present invention provides a mass spectrometer which is capable of measuring masses over a wide range and excellent in sensitivity and resolution and which can be miniaturized.

Having described the invention with the detail and particularity required by the Patent Laws, what is desired protection by Letters Patent is set forth in the following claims.

I claim:

1. A mass spectrometer having an ion source, an ion detector for detecting the ions emitted from the ion source, a uniform magnetic field set up between the ion source and the ion detector, an electric field set up between the magnetic field and the ion detector, and two electrostatic quadrupole lenses disposed between the ion source and the magnetic field in spaced relation to each other for converging the beam of the ions in a direction perpendicular to the plane of the orbit of the beam and for diverging the beam radially of the beam, another electrostatic quadrupole lens disposed between the magnetic field and the electric field to converge the beam in the direction of the plane of said orbit, such that the deflection angle $\phi_m$ of the beam in the magnetic field, the radius $r_m$ of the circle described by the beam in the magnetic field, the deflection angle $\phi_e$ of the beam in the electric field, and the radius $r_e$ of the circle described by the beam in the electric field are so set as to satisfy the following relations:

$$82° \leqq \phi_e \leqq 88°$$

$$39° \leqq \phi_m \leqq 41°$$

$$0.715 \leqq r_e/r_m \leqq 0.755$$

2. Apparatus according to claim 1 wherein the quadrupole lenses have Py electrodes spaced from the ion beam path in the y-direction and Px poles spaced from the ion beam path in the x-direction and the polarity of the voltage applied to the Py electrodes is the same as that of the ions being analyzed.

3. Apparatus according to claim 2 wherein the entrance end surface and the exit end surface of the magnetic field are tilted to cause the beam of ions to enter and leave the field obliquely.

4. Apparatus according to claim 3 wherein the entrance end surface is curved.

* * * * *